US009766003B2

(12) United States Patent
Li et al.

(10) Patent No.: US 9,766,003 B2
(45) Date of Patent: Sep. 19, 2017

(54) AIR CONDITIONER CONTROLLER, AIR CONDITIONER CONTROL CIRCUIT AND AIR CONDITIONER CONTROL METHOD

(71) Applicant: HANGZHOU LEADERWAY ELECTRONICS CO., LTD., Hangzhou (CN)

(72) Inventors: Shangen Li, Hangzhou (CN); Wenming Run, Hangzhou (CN); Shanzeng Cheng, Hangzhou (CN)

(73) Assignee: HANGZHOU LEADERWAY ELECTRONICS CO., LTD., Hangzhou, Zhejiang (CN)

( * ) Notice: Subject to any disclaimer, the term of this patent is extended or adjusted under 35 U.S.C. 154(b) by 372 days.

(21) Appl. No.: 14/677,831

(22) Filed: Apr. 2, 2015

(65) Prior Publication Data

US 2015/0285529 A1 Oct. 8, 2015

(30) Foreign Application Priority Data

Apr. 3, 2014 (CN) ..... 2014 1 0142214

(51) Int. Cl.
*H02P 7/00* (2016.01)
*F25B 49/00* (2006.01)
*F24F 11/00* (2006.01)

(52) U.S. Cl.
CPC ..... *F25B 49/005* (2013.01); *F24F 2011/0084* (2013.01); *F25B 2700/151* (2013.01); *F25B 2700/1931* (2013.01); *F25B 2700/21152* (2013.01)

(58) Field of Classification Search
CPC .. H02H 7/08; H02H 7/09; H02H 7/20; H02H 3/006; H02H 3/08; H02H 5/041; F25B 49/022; F25B 2500/19; F25B 2600/0251; F25B 2700/13; F25B 2700/151; F25B 2700/2115; F25B 2400/075; F25B 2400/22
USPC ..... 318/400.02, 400.22, 432, 434; 361/22, 361/30, 31; 62/228.1, 132
See application file for complete search history.

(56) References Cited

U.S. PATENT DOCUMENTS 6,647,735 B2 * 11/2003 Street ..... F25B 49/02 236/51
7,089,088 B2 * 8/2006 Terry ..... F24F 11/0086 700/276

(Continued)

*Primary Examiner* — Paul Ip
(74) *Attorney, Agent, or Firm* — Squire Patton Boggs (US) LLP

(57) ABSTRACT

An air conditioner controller and a safety protection circuit for the same are provided. The air conditioner controller includes a central processing unit, a drive unit, a safety locking unit and a protection detection unit, where the central processing unit is configured to output an air conditioner control signal; the air conditioner motor drive unit is configured to receive a drive control signal output from the safety locking unit and the detection protection signal, and output a drive signal to control an operation of an air conditioner motor; the safety locking unit is configured to receive the detection protection signal and the air conditioner control signal, output the drive control signal, and control the air conditioner control signal to be transmitted or cut off based on the detection protection signal output from the protection detection unit.

23 Claims, 5 Drawing Sheets

(56) References Cited

U.S. PATENT DOCUMENTS 8,045,302 B2 * 10/2011 Jayanth ..... G01R 19/10 318/432
8,228,648 B2 * 7/2012 Jayanth ..... G01R 19/10 307/85
8,493,014 B2 * 7/2013 Henderson ..... H02P 21/0089 318/400.22
8,605,393 B2 * 12/2013 Jayanth ..... G01R 19/10 307/125
8,964,338 B2 * 2/2015 Wallis ..... H02H 5/041 318/432
2002/0020175 A1 * 2/2002 Street ..... F25B 49/02 62/132
2005/0240312 A1 * 10/2005 Terry ..... F24F 11/0086 700/276
2009/0225479 A1 * 9/2009 Jayanth ..... G01R 19/10 361/30
2011/0031920 A1 * 2/2011 Henderson ..... H02P 21/0089 318/434
2011/0033173 A1 * 2/2011 Bonner ..... H02P 23/0077 388/805
2012/0039006 A1 * 2/2012 Jayanth ..... G01R 19/10 361/62
2012/0280709 A1 * 11/2012 Jayanth ..... G01R 19/10 324/765.01
2013/0176649 A1 * 7/2013 Wallis ..... H02H 5/041 361/24
2013/0264977 A1 * 10/2013 Bonner ..... H02P 23/0077 318/400.02
2014/0074730 A1 * 3/2014 Arensmeier ..... F24F 11/0086 705/305
2014/0130531 A1 * 5/2014 Jayanth ..... G01R 19/10 62/228.1
2014/0262134 A1 * 9/2014 Arensmeier ..... F24F 11/02 165/11.2
2014/0266755 A1 * 9/2014 Arensmeier ..... F24F 11/0086 340/679
2014/0297208 A1 * 10/2014 Arensmeier ..... G05B 23/0224 702/58
2015/0155701 A1 * 6/2015 Wallis ..... H02H 5/041 361/31
2016/0190799 A1 * 6/2016 Jayanth ..... G01R 19/10 361/30

* cited by examiner

AIR CONDITIONER CONTROLLER, AIR CONDITIONER CONTROL CIRCUIT AND AIR CONDITIONER CONTROL METHOD

CROSS-REFERENCES TO RELATED APPLICATIONS

The present application claims priority to Chinese Patent Application No. 201410142214.2, filed with the State Intellectual Property Office of People's Republic of China on Apr. 3, 2014 entitled "AIR CONDITIONER CONTROLLER AND SAFETY CONTROL CIRCUIT FOR THE SAME", the content of which is incorporated herein by reference in its entirety.

FIELD

The disclosure relates to the field of the air conditioner, and in particular to an air conditioner controller having two or more types of safety protection circuits.

BACKGROUND

In an air conditioner system, the potential risk of the air conditioner includes the following aspects: excessively high compressor exhaust pressure may cause pipeline to burst, and thus erupted fragments and high pressure gas may spurt and hurt persons; and excessively high operating current of a compressor or a fan may result in excessively high temperature of the compressor or the fan, and thereby cause over-pressure of refrigerant or damage of the insulation. Components relating to the security are generally controlled by a control circuit. In order to avoid a security accident, a safety protection apparatus should be provided for the components, for example, a safety valve is provided for the compressor, or a protection circuit is provided for a control circuit of the compressor and the fan.

Electrical appliances are generally equipped with these safety protection apparatuses, but these safety protection apparatuses only provide a single protection. If a device of the safety apparatus malfunctions, the whole safety apparatus may malfunction and result in an accident. Since the safety protection apparatus only provides the single protection, the protection failures entirely once the safety protection apparatus is disabled.

In order to avoid the exhaust temperature/pressure from being too high, some of the conventional air conditioner safety circuits are equipped with exhaust temperature sensors, and some great power types of the circuits are further equipped with high pressure protection switches; however, in the safety circuits, physical parameters are only simply transmitted from a sensor to an microprocessor chip unit (MCU), and the protection is entirely realized by the software of the MCU. These type of safety protection circuits do not have a single-fault-tolerance design and a single-fault-tolerance ability. In addition, these sensors are directly connected to the MCU without a safety isolation circuit; and in order to save cost, a control circuit scheme in which the MCU is not isolated from the power supply is adopted in many air conditioner controllers; thus, the exhaust temperature sensor or the high pressure protection switch is not isolated from the power supply, and there is a risk of an electric shock and a potential security problem.

Hence, it is necessary to improve the conventional air conditioner protection apparatus, thereby realizing better protection for the air conditioner system.

SUMMARY

An object of the disclosure is to provide an air conditioner control circuit including a safety detection protection circuit, which can provide at least two types of safety protection for an air conditioner system.

Another object of the disclosure is to provide an air conditioner controller, of which a control circuit can provide at least two types of safety protection for an air conditioner system.

Yet another object of the disclosure is to provide an air conditioner control method, which can provide at least two types of safety protection for an air conditioner system.

In order to achieve the above objects, the disclosure provides an air conditioner control circuit, which includes a central processing unit, an air conditioner motor drive unit, a protection detection unit and a safety locking unit, wherein, the protection detection unit detects an operation condition of an air conditioner and output a detection protection signal;

the central processing unit outputs an air conditioner control signal;

the air conditioner motor drive unit receives a drive control signal output from the safety locking unit and the detection protection signal output from the protection detection unit, and outputs a drive signal to control an operation of an air conditioner motor, wherein the drive signal is capable of being output by the air conditioner motor drive unit based on the drive control signal and the detection protection signal; and the safety locking unit receives the detection protection signal output from the protection detection unit and the air conditioner control signal output from the central processing unit, outputs the drive control signal, and controls the air conditioner control signal output from the central processing unit to the air conditioner motor drive unit to be transmitted or cut off based on the detection protection signal output from the protection detection unit.

The disclosure further provides an air conditioner controller, which includes an input terminal and an output terminal, wherein the input terminal receives a signal from a sensor and an air conditioner control instruction signal, the output terminal outputs an air conditioner element control signal, and the air conditioner controller further includes the air conditioner control circuit described above.

The disclosure further provides an air conditioner control method, wherein, the air conditioner includes an air conditioner motor and an air conditioner controller for controlling an operation of the air conditioner motor; the air conditioner controller includes an air conditioner control circuit; the air conditioner control circuit includes a central processing unit, an air conditioner motor drive unit, a protection detection unit and a safety locking unit; and the method includes:

outputting, by the central processing unit, an air conditioner control signal; detecting, by the protection detection unit, an operation condition of the air conditioner and outputting a detection protection signal based on the detected operation condition;

receiving, by the safety locking unit, the air conditioner control signal and the detection protection signal, outputting a drive control signal to the air conditioner motor drive unit, and controlling the air conditioner control signal output from the central processing unit to the air conditioner motor drive unit to be transmitted or cut off based on the detection protection signal output from the protection detection unit; and receiving, by the air conditioner motor drive unit, the drive control signal and the detection protection signal, and outputting a drive signal to control an operation of the air conditioner motor, wherein the drive signal is capable of being output by the air conditioner motor drive unit based on the drive control signal and the detection protection signal.

As compared with the conventional technology, in the air conditioner control circuit, the air conditioner controller and the air conditioner control method according to the disclosure, the protection signal is transmitted on three paths. On the first path, the protection signal output from the protection detection unit is input directly to the drive unit of the air conditioner motor, and the drive unit stops driving the motor; on the second path, the protection signal is transmitted to the safety locking unit to cut off the drive control signal transmitted from the central processing unit to the drive unit; on the third path, the protection signal is output to the central processing unit to control the central processing unit to stop sending the driving signal; in this way, the air conditioner motor drive unit, the safety locking unit and the central processing unit each may control an operation of the air conditioner motor based on the detection signal output from the protection detection unit. Both the drive unit and the safety locking unit are hardware protection circuits, although one path loses the protection function due to the breakdown of any element, the protection signal still can be transmitted on another path, which realizes a reliable protection function, thereby triple safety protection is provided. In addition, the signal output from the protection detection unit is isolated from the central processing unit, the safety locking unit and the drive unit by two series-connected optical couplers, thereby avoiding the damage of each processing unit caused by the detection signal directly input to the processing unit, and ensuring that the protection detection unit operates safely with an isolation power supply. Two series-connected optical couplers are adopted in the protection detection unit, by which the case that the output terminal of one optical coupler is breakdown or shot circuited can be tolerated; once a failure occurs in one optical coupler, the other optical coupler can still transmit the protection signal, thereby providing two or more types of safety protection for the air conditioner.

DETAILED DESCRIPTION

Specific embodiments of the disclosure will be illustrated in conjunction with the drawings hereinafter.

Figure 1:
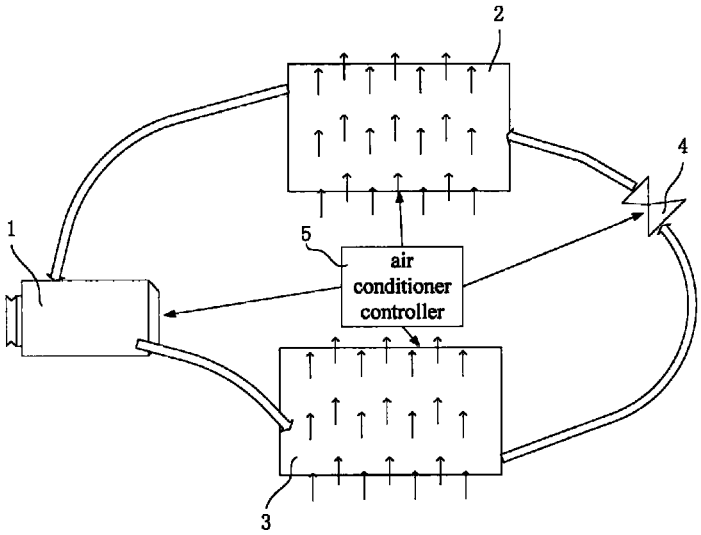
FIG. 1 is a schematic diagram of an air conditioner according to an embodiment of the disclosure.

Reference is made to FIG. 1 which is a schematic diagram of a part of an air conditioner system according to an embodiment of the disclosure. The air conditioner system as shown in FIG. 1 includes a compressor 1, an evaporator 2, a condenser 3, an expansion valve 4 and an air conditioner controller 5. The air conditioner controller 5 outputs control signals to control operation of various units.

Figure 2:
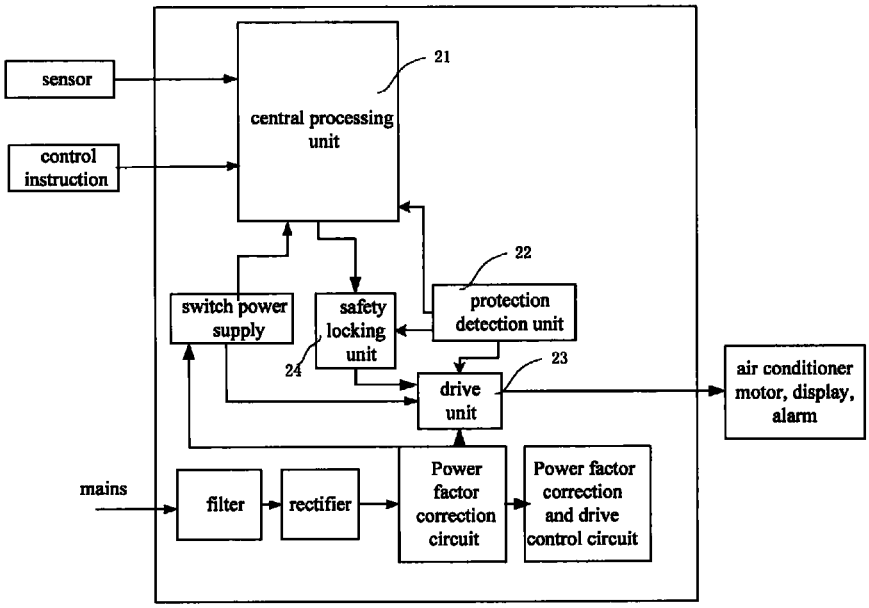
FIG. 2 is a schematic block diagram of an air conditioner controller according to an embodiment of the disclosure.

Reference is made to FIG. 2 which is a schematic block diagram of an air conditioner controller according to an embodiment of the disclosure. In the embodiment, the air conditioner controller mainly includes a central processing unit 21, a protection and detection unit 22 and a drive unit 23. The central processing unit 21 is configured to receive input information for example temperature sensor information and a control instruction for an indoor unit, and output an air conditioner control signal by calculation. The protection and detection unit 22 is configured to collect a safety signal on a motor of the air conditioner to determine whether the motor of the air conditioner operates safely. The drive unit 23 is configured to drive an air conditioner motor.

As shown in FIG. 2, mains is corrected by a filtering unit, a rectifying unit and a power factor correcting unit and then transmitted to a switching power supply unit. The switching power supply unit provides power for the central processing unit 21 and the drive unit 23. The central processing unit 21 receives an input signal for example a signal transmitted from a sensor, a control instruction received by the indoor unit or a detection signal from the protection detection unit, and outputs an air conditioner control signal by calculation.

In the embodiment of the disclosure, a control signal for controlling the air conditioner motor output from the central processing unit 21 is transmitted to the drive unit 23 via a safety locking unit 24, and then a control signal is output from the drive unit 23 to control a motor of the air conditioner for example a compressor or a fan motor to operate. Based on the collected safety signal, the protection and detection unit 22 directly turns off the safety locking unit 24 and the drive unit 23 and sends an alarm to the central processing unit 21, when there is a safety warning. In this way, the central processing unit 21 of the air conditioner controller can stop outputting a drive signal, the safety locking unit 24 can cut off a signal transmitted from the central processing unit to the drive unit, and the drive unit 23 itself can stop driving the motors of the air conditioner. In the case that one path malfunctions, a protection signal still can be transmitted normally on the other two paths, thereby triple safety protection for the air conditioner motor is provided.

Figure 3:
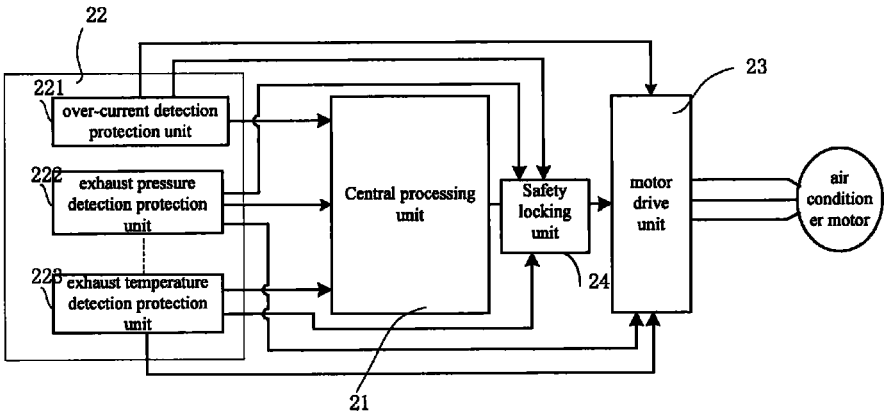
FIG. 3 is a schematic block diagram of a protection circuit of an air conditioner controller according to an embodiment of the disclosure.

Reference is made to FIG. 3, which is a schematic block diagram for controlling a motor of the air conditioner by the central processing unit 21 according to an embodiment of the disclosure. As shown in FIG. 3, the air conditioner controller of the disclosure includes a protection detection unit 22, a central processing unit 21, a safety locking unit 24 and a drive unit 23. An output terminal of the protection detection unit 22 is connected to an input terminal of the central processing unit 21, an input terminal of the safety blocking unit 24 and an input terminal of the drive unit 23. An output terminal of the central processing unit 21 is connected to another input terminal of the safety locking unit 24, and an output terminal of the safety locking unit 24 is connected to another input terminal of the air conditioner motor drive unit 23. A drive signal is output from an output terminal of the air conditioner motor drive unit 23 to control an operation of the motor of the air conditioner. Various units are illustrated respectively hereinafter.

As shown in FIG. 3, the protection detection unit 22 of the disclosure includes an over-current detection protection unit 221, an air conditioner compressor exhaust pressure detection protection unit 222 and an air conditioner compressor exhaust temperature detection protection unit 223.

The over-current detection protection unit 221 is configured to detect a current in a compressor motor of the air conditioner, and output an over-current protection signal in the case that the current in the compressor motor is too large. The air conditioner compressor exhaust pressure detection protection unit 222 is configured to detect an exhaust pressure of the air conditioner compressor, and output an exhaust overpressure protection signal in the case that the exhaust pressure of the compressor is too large. The air conditioner compressor exhaust temperature detection protection unit 223 is configured to detect an exhaust temperature of the air conditioner compressor, and output an exhaust over-temperature protection signal in the case that the exhaust temperature of the compressor is too high. In the embodiment of the disclosure, protection signals output from the over-current detection protection unit 221, the air conditioner compressor exhaust pressure detection protection unit 222 and the air conditioner compressor exhaust temperature detection protection unit 223 are directly transmitted to the motor drive unit 23 along one path to make the motor drive unit 23 stop driving the motor, transmitted to the safety locking unit 24 along another path to lock a drive control signal transmitted from the central processing unit 21 to the motor drive unit 23, and output to the central processing unit 21 along yet another path to control the central processing unit 21 to stop sending a motor drive signal.

The central processing unit 21 of the disclosure may be a microprocessor chip unit (MCU), which receives input information and outputs a control signal by calculation. The specific internal structure and the calculation method of the microprocessor chip unit are not described here.

The safety locking unit 24 of the disclosure is connected between the central processing unit 21 and the drive unit 23, and configured to control the central processing unit 21 to transmit a control signal to the drive unit 23. Once a there is a safety warning, the safety locking unit 24 cuts off the drive control signal transmitted from the central processing unit 21 to the motor drive unit 23 based on a detection signal from the detection protection unit 22.

The motor drive unit 23 of the disclosure is a circuit for driving a motor to operate, and the structure of the circuit dependents that of a motor of the air conditioner. It will be further illustrated in the specific embodiments hereinafter.

Figure 4:
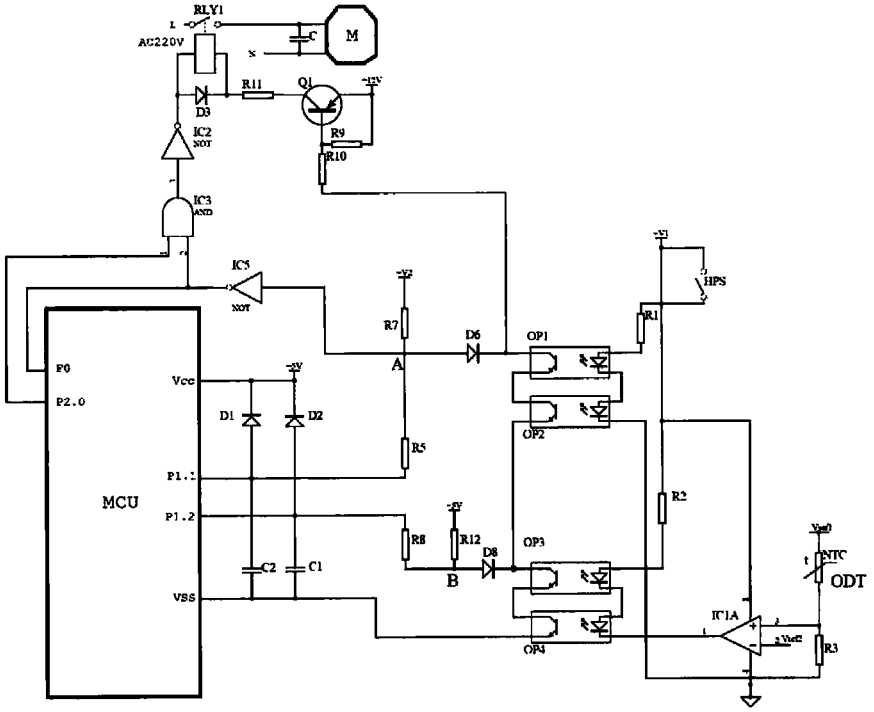
FIG. 4 is a schematic circuit diagram of an air conditioner controller according to a first embodiment of the disclosure.

Reference is made to FIG. 4 which shows a schematic circuit diagram of air conditioner controller according to a first embodiment of the disclosure. In the embodiment, the detection protection unit includes only an air conditioner compressor exhaust pressure detection protection unit and an air conditioner compressor exhaust temperature detection protection unit, and does not include an aforementioned over-current detection protection unit. The air conditioner is a fixed-frequency air conditioner, and a drive unit for driving motors of the air conditioner is a relay.

As shown in FIG. 4, the central processing unit 21 of the air conditioner controller of the disclosure is a microprocessor chip unit (MCU), which includes an output terminal P2.0 for outputting an air conditioner motor control signal, and input terminals P1.1 and P1.2 for receiving a signal input from the detection unit. In other embodiments, the central processing unit may be a thermo switch or a device for sending a switch on/off instruction, rather than a microprocessor.

In the embodiment as shown in FIG. 4, the compressor exhaust pressure detection protection unit 222 includes a high pressure detection protection switch (HPS), one terminal of the HPS is connected to a power supply V1, another terminal of the HPS is connected to light emitting diodes of at least two optical couplers OP1 and OP2 in series via a resistor R1. A terminal of the optical coupler OP1 for receiving light emitted from the light emitting diode functions as an output terminal. Two or more optical couplers are connected in series, which can bear that the output terminal of one optical coupler is breakdown or short-circuited.

In the embodiment as shown in FIG. 4, the compressor exhaust temperature detection protection unit 223 includes a temperature sensor ODT with a negative temperature coefficient. Since there is a linear relationship between a temperature of and a pressure of a refrigerant compressed gas, the higher the pressure is, the higher the temperature is. Hence, the ODT may also be used as another dual-fold-single-fault-tolerance detection method for detecting the exhaust pressure. A reference voltage Vref1 is input to a terminal of the thermistor sensor ODT with the negative temperature coefficient, another terminal of the ODT is connected to an input terminal of a voltage comparator IC1A, and a reference voltage Vref2 is input to another input terminal of the voltage comparator IC1A; an output terminal of the voltage comparator IC1A is connected to light emitting diodes of at least two optical couplers OP3 and OP4 in series, and a terminal of the optical coupler OP3 for receiving light emitted from the light emitting diode functions as an output terminal of the compressor exhaust temperature detection protection unit.

In the embodiment as shown in FIG. 4, output terminals of the two optical couplers OP1 and OP2 of the compressor exhaust pressure detection protection unit are connected to output terminals of the two optical couplers OP3 and OP4 of the compressor exhaust temperature detection protection unit in series.

The drive unit comprises a relay RLY1 including a relay coil and a switch. The relay coil is connected to a diode D3 in parallel and connected to a +12V power supply via a switching transistor Q1. A first terminal of the switching transistor Q1 is connected to a negative electrode of the diode D3 of the drive unit, a second terminal of the switching transistor Q1 is connected to the +12V power supply, and a control terminal of the switching transistor Q1 is controlled by the protection detection unit. In the case that the switching transistor Q1 is turned on, the relay coil is connected to the +12V power supply. In the case that a low level signal is output from a NOT gate IC2 under the control of the MCU, the relay is turned on and the motor is power on to operate; and in the case that a protection signal is output from the exhaust detection unit, the switching transistor Q1 is turned off to disconnect the relay coil from the +12V power supply, the relay is turned off and the motor M is power off to stop operating.

In the embodiment as shown in FIG. 4, the safety locking unit located between the central processing unit and the motor drive unit includes an AND gate IC3, a drive NOT gate IC2 connected to an output terminal of the AND gate IC3, and a NOT gate IC5 connected to an input terminal of the AND gate IC3. Practically, in other embodiments, the safety locking unit may also be an NAND gate or an NOR gate, the safety locking unit is configured to cut off or transmit the control signal transmitted from the central processing unit to the drive unit based on the protection signal output from the protection detection unit.

Hereinafter operation processes of the compressor exhaust pressure detection protection unit and the compressor exhaust temperature detection protection unit in the embodiment as shown in FIG. 4 will be described respectively.

A HPS protection switch of the compressor exhaust pressure detection protection unit is in a normally-on state under a normal air pressure; in the case that the compressor exhaust pressure reaches a certain threshold, the HPS protection switch is turned off to cut off a loop of the light emitting diodes of the optical couplers OP1 and OP2 functioning as isolation switches, there is no light emitted from the light emitting diodes due to no current passing through the light emitting diodes, and both the optical couplers OP1 and OP2 are turned off. In this case, even if an output terminal of one optical coupler is breakdown or short circuited, a node on the output terminal of the optical coupler OP1 is at a high level, hence a variation of the level of the output terminal node may function as a compressor exhaust overpressure protection signal output from the compressor exhaust pressure detection protection unit. The switching transistor Q1 is connected between the diode D3 and the +12V power supply, and output terminals of the two optical couplers OP1 and OP2 of the compressor exhaust pressure detection protection unit are connected to the control terminal of the switching transistor Q1 via a resistor R10; the first terminal of the switching transistor Q1 is connected to the relay coil and the negative electrode of the diode D3 of the drive unit, the second terminal of the switching transistor Q1 is connected to the +12V power supply, and the signals output from the terminals of the two optical couplers OP1 and OP2 of the compressor exhaust pressure detection protection unit control the switching transistor Q1 to be turned on or off. Under a normal pressure, the output terminal of the optical coupler OP1 of the compressor exhaust pressure detection protection unit is on a low level, the control terminal of the switching transistor Q1 is on a low level, the switching transistor Q1 is turned on, and the relay coil of the drive unit is connected to the +12V power supply; if the MCU sends a drive instruction, the relay switch is turned on and the motor operates normally. In the case that the compressor exhaust pressure is too high, the optical couplers of the compressor exhaust pressure detection protection unit are turned off, the output terminal of the optical coupler OP1 is on a high level, the control terminal of the switching transistor Q1 is on a high level, the switching transistor Q1 is turned off, the relay coil of the drive unit is disconnected from the +12V power supply and is power off; although the MCU sends a drive instruction, the relay switch is still turned off, the compressor motor stops operating, thereby preventing the exhaust pressure from further increasing and achieving safety protection.

The output terminals of the two optical couplers OP1 and OP2 of the compressor exhaust pressure detection protection unit are connected to a negative electrode of a diode D6; a positive electrode of the diode D6 is connected to a node A, and the node A is connected to a power supply V2 via a resistor R7. The node A is connected to an input terminal P1.1 of the central processing unit via a resistor R5 and a clamping diode D1. The central processing unit performs a calculation based on a signal received by the input terminal P1.1, and outputs a turning-off air conditioner motor control signal from the output terminal P2.0. The node A is also connected to an input terminal of the NOT gate IC5 of the safety locking unit, an output terminal of the NOT gate IC5 is connected to an input terminal of the AND gate IC3, an output terminal of the AND gate IC3 is connected to a positive electrode of the diode D3 of the drive unit via the NOT gate IC2, i.e., the output terminal of the safety locking unit is connected to the positive electrode of the diode D3 of the drive unit.

In case of a normal compressor exhaust pressure, the optical coupler of the compressor exhaust pressure detection protection unit is turned on, the output terminal node of the optical coupler OP1 is on a low level, the diode D6 is turned on because that a forward voltage is applied to the diode D6, a voltage of the node A is also on a low level, the IC3 is unlocked due to the inversion action provided by the IC5, so that the MCU control signal controls the relay to be turned on and controls the motor to operate. In the case that the compressor exhaust pressure is too high, the two optical couplers OP1 and OP2 of the compressor exhaust pressure detection protection unit are turned off, the output terminal node of the optical coupler OP1 is on a high level, the diode D6 is turned off because a reverse voltage is applied to the diode D6, the node A is on a high level, the IC3 is locked due to the inversion action provide by the IC5, that is, the signal for controlling the motor sent from the MCU is cut off and the motor can not operate, thereby preventing the exhaust pressure from further increasing and achieving safety protection.

According to the aforementioned protection method of using the two-path blocking relay and blocking the MCU from controlling the motor, once there is a fault on one path due to breakdown of an element, the protection signal still can be transmitted on another path and a reliable protection function can be achieved.

For the compressor exhaust temperature detection protection unit, in the case that the compressor exhaust temperature is high, the resistance of the ODT temperature sensor of the compressor exhaust temperature detection protection unit is small, such that a voltage of an input terminal node of the ODT temperature sensor connected to the voltage comparator IC1A increases and exceeds a threshold Vref2 of the voltage comparator IC1A, an open circuit occurs, the optical couplers OP3 and OP4 are turned off due to the power off of light emitting diodes of the optical couplers OP3 and OP4, a level of the output terminal of the optical coupler OP3 changes, and the variation of the level of the output terminal of the optical coupler OP3 may function as the compressor exhaust over-temperature protection signal output from the compressor exhaust temperature detection protection unit. In the embodiment, the output terminal of the optical coupler OP3 of the compressor exhaust temperature detection protection unit is connected to the optical coupler OP2 of the compressor exhaust pressure detection protection unit in series, hence the compressor exhaust temperature detection protection unit and the compressor exhaust pressure detection protection unit share the same line to transmit the signal to the drive unit and the safety locking unit, i.e., the compressor exhaust temperature detection protection unit also transmits the protection signal to the drive unit by controlling the relay coil of the drive unit to be power on or power off using the switching transistor Q1, and the compressor exhaust temperature detection protection unit also transmits the protection signal to the safety locking unit by controlling the control signal transmitted from the central processing unit to the drive unit based on the output of the AND gate IC3, such that the relay coil of the drive unit is power on or power off, which is not describe here.

In order to determine whether a protection signal is output from the compressor exhaust pressure detection protection unit or the compressor exhaust temperature detection protection unit, the output terminal of the optical coupler OP3 of the compressor exhaust temperature unit is further connected to a negative electrode of a diode D8; a positive electrode of the diode D8 is connected to a node B, and the node B is connected to a +5V power supply via a resistor R12 and also connected to the input terminal P1.2 of the central processing unit via a resistor R8 and a clamping diode D2. The central processing unit performs a calculation based on a signal received by the input terminal P1.2, and outputs an ODT overheat alarm and turning-off air conditioner motor control signal through the output terminal P2.0.

In the embodiment, the protection detection unit includes the compressor exhaust pressure detection protection unit and the compressor exhaust temperature detection protection unit. In the case that the compressor exhaust pressure reaches a certain threshold, an exhaust pressure protection signal is output from the compressor exhaust pressure detection protection unit; and in the case that the compressor exhaust temperature reaches a certain threshold, an exhaust temperature protection signal is output from the compressor exhaust temperature detection protection unit. The protection signal is isolated by the series-connected optical couplers, and then is input to the drive unit for driving the motor via the switching transistor along one path to stop driving the motor; and the protection signal is input to the safety locking unit along another path, the safety locking unit cuts off the control signal transmitted from the central processing unit to the drive unit; and the protection signal is input to the central processing unit along yet another path, such that the central processing unit stops outputting the drive control signal, thereby providing triple safety protection for the air conditioner. Once one path malfunctions due to the breakdown of an element, other paths can still provide a reliable protection function. The series-connected optical coupler can prevent the signal from being transmitted from the protection detection unit to the central processing unit, such that the damage to the central processing unit can be avoided, and the temperature sensor and the high pressure protecting switch can be ensured to operate with a safe isolation power supply; in addition, the protection detection unit provides its output through the series-connected optical couplers, which is able to tolerate the case that the output terminal of one optical coupler is breakdown or short-circuited; once a failure occurs in one optical coupler, another optical coupler can still transmit the protection signal, and multiple safety protection paths are provided and the function of "single-fault-tolerance" is realized.

Figure 5:
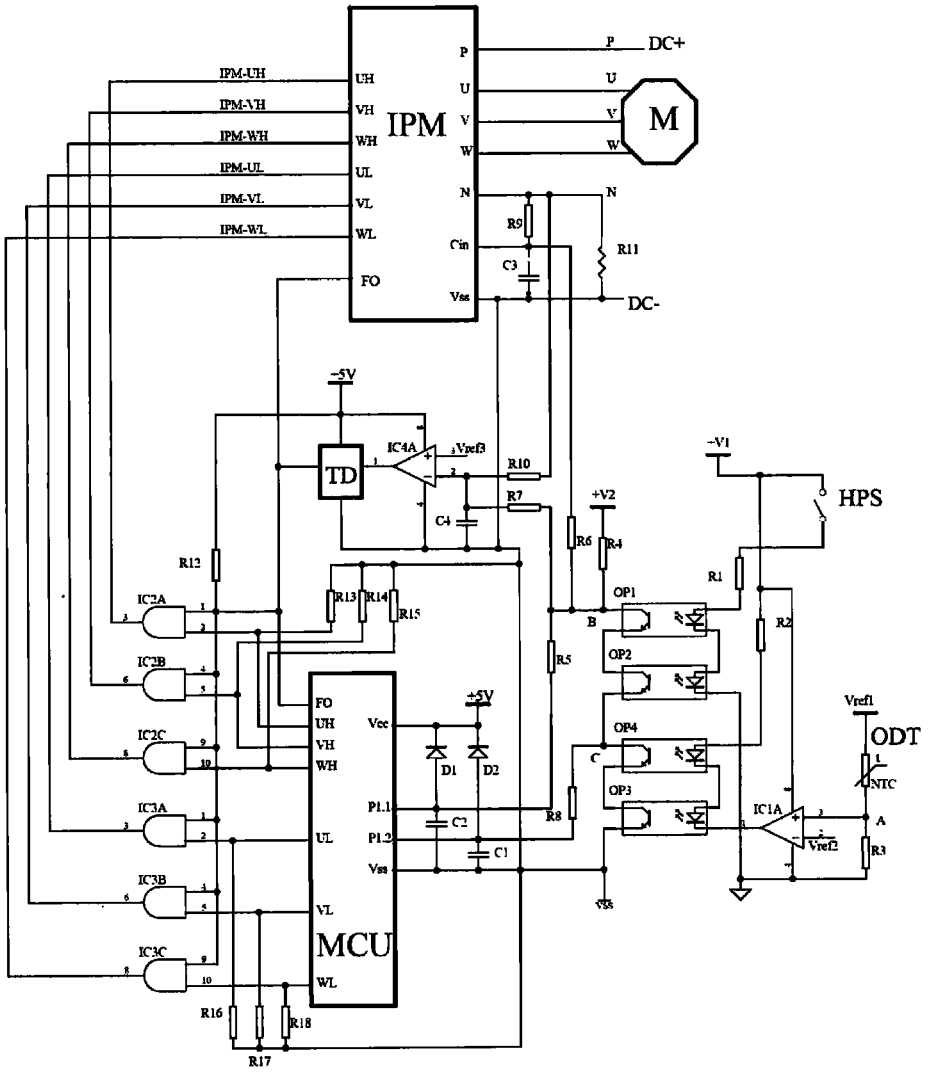
FIG. 5 is a schematic circuit diagram of an air conditioner controller according to a second embodiment of the disclosure.

Reference is made to FIG. 5 which is a schematic circuit diagram of an air conditioner controller according to a second embodiment of the disclosure. In the embodiment, the air conditioner is a variable frequency air conditioner, and the drive unit is an intelligent power module (IPM) including an intelligent control (IC) circuit and a three-phase inverter bridge consisting of a switching transistor.

As shown in FIG. 5, the central processing unit 21 of the air conditioner controller of the disclosure is a microprocessor chip unit (MCU), which includes output terminals UH, VH, WH, UL, VL and WL for outputting a three-phase motor control signal, and input terminals F0, P1.1 and P1.2.

The IPM 23 is a power integrated circuit chip, which includes input terminals UH, VH, WH, UL, VL and WL for receiving a motor control signal output from the central processing unit 21, output terminals U, V and W for outputting a control signal for controlling a three-phase current of the motor M, and an over-current protection input terminal Cin. The IPM includes a voltage comparator and a locking circuit In the embodiment as shown in FIG. 5, the over-current detection protection unit 221 mentioned above includes a current sampling resistor R11. FIG. 5 does not show the whole current sampling circuit and only shows the current sampling resistor R11. In a sampling circuit, the current sampling resistor R11 is connected to a sampling node, a current flowing through the current sampling resistor R11 may be obtained by detecting a voltage across the current sampling resistor R11, thereby the value of the three-phase current can be determined, the specific circuit and the method for current sampling are not described here.

In the embodiment as shown in FIG. 5, the compressor exhaust pressure detection protection unit 222 includes a high pressure detection protection switch (HPS), and the HPS is connected to light emitting diodes of at least two optical couplers OP1 and OP2 in series via a resistor R1. Under a normal air pressure, the HPS protection switch is in a normally-on state; in the case that the compressor exhaust pressure reaches a certain threshold, the HPS protection switch is turned off and loops of light emitting diodes of the optical couplers OP1 and OP2 functioning as isolation switches are cut off, thereby the optical couplers are power off and turned off, output terminals of the optical couplers OP1 and OP2 are open and the output terminal of the OP1 is on a high level, i.e., a compressor exhaust overpressure protection signal is output from the compressor exhaust pressure detection protection unit.

In the embodiment as shown in FIG. 5, the compressor exhaust temperature detection protection unit 223 includes a temperature sensor ODT with a negative temperature coefficient; since there is a linear relationship between a saturated temperature and a pressure of a refrigerant compressed gas, the higher the pressure is, the higher the temperature is, and the ODT may be used as another dual-fold-single-fault-tolerance detection method for detecting an exhaust pressure. A reference voltage Vref1 is input to a terminal of the thermistor sensor ODT with the negative temperature coefficient, another terminal of the thermistor sensor ODT is connected to an input terminal of a voltage comparator IC1A; a reference voltage Vref2 is input to another input terminal of the voltage comparator IC1A, an output terminal of the voltage comparator IC1A is connected to at least two optical couplers OP3 and OP4 in series, and output terminals of the two optical couplers OP3 and OP4 function as an output terminal of the compressor exhaust temperature detection protection unit. In the case that the compressor exhaust pressure is high, the exhaust temperature is also high, a resistance of the ODT temperature sensor is small, such that a voltage of a node A at one terminal of the ODT temperature sensor increases and exceeds a threshold Vref2 of the voltage comparator IC1A, an open circuit occurs, loops of light emitting diodes of the isolation optical couplers OP3 and OP4 are power off to turn off the optical couplers OP3 and OP4, the optical couplers OP3 and OP4 are in an open-circuit and the output terminal of the OP3 is on a high level, i.e., a compressor exhaust over-temperature protection signal is output from the compressor exhaust temperature detection protection unit.

In the embodiment as shown in FIG. 5, the safety locking unit 24 includes a time delay circuit TD, and AND gates IC2A, IC2B, IC2C, IC3A, IC3B and IC3C connected to output terminals UH, VH, WH, UL, VL and WL of the central processing unit respectively.

Hereinafter operation processes of the over-current detection protection unit, the compressor exhaust pressure detection protection unit, and the compressor exhaust temperature detection protection unit are described according to the embodiment of the disclosure as shown in FIG. 5.

As shown in FIG. 5, a current detection signal collected by the current sampling resistor R11 of the over-current detection protection unit is input to an over-current protection input terminal Cin of the IPM 23 via a filtering circuit consisting of a resistor R9 and a capacitor C3. The IPM includes a voltage comparator and a locking circuit, in the case that a voltage across the current sampling resistor R11 exceeds 0.5V, a voltage received by the over-current protection input terminal Cin of the IPM 23 exceeds an over-current reference voltage of the voltage comparator of the IPM 23 accordingly, a control signal is output from the IPM 23 to cut off a drive power supply for the motor to protect the motor.

The current detection signal from the current sampling resistor R11 of the over-current detection protection unit is input to an input terminal of a voltage comparator IC4A via a resistor R10, and a reference voltage Vref3 of 0.5V is input to another terminal of the voltage comparator IC4A. The current detection signal from the over-current detection protection unit is compared with the reference voltage Verf3 by the voltage comparator IC4A; in the case that the current detection signal from the over-current detection protection unit is higher than the reference voltage Vref3, the voltage comparator IC4A outputs a high level signal to trigger the time delay circuit TD of the safety locking unit, lock AND gates IC2A, IC2B, IC2C, IC3A, IC3B and IC3C, and cut off a three-phase signal for driving the IPM output from the central processing unit along six paths.

In the embodiment, the over-current detection protection unit sends an alarm by means of variation of the level of FO when outputting the over-current protection signal or the IPM protection signal, and outputs an alarm signal to an input terminal FO of the central processing unit. The central processing unit changes the input signal based on the electric level of the input terminal FO, performs a calculation internally, and outputting a control signal for controlling the IPM to be stopped promptly.

Still referring to FIG. 5, in the case that exhaust pressure of the air conditioner compressor is too high, the high pressure detection protection switch (HPS) of the compressor exhaust pressure detection protection unit is turned off, light emitting diodes of two optical couplers OP1 and OP2 series-connected to the HPS are power off, output terminals of the optical couplers are also turned off, an output terminal node B of the optical coupler OP1 is on a high level, that is, an exhaust overpressure protection signal is output from the compressor exhaust pressure detection protection unit. The exhaust overpressure protection signal output from the compressor exhaust pressure detection protection unit is input to an over-current protection input terminal Cin of the IPM via a resistor R6 to generate a virtual high voltage, the virtual high voltage is received by the over-current protection input terminal Cin of the IPM and exceeds an over-current reference voltage of the over-current voltage comparator of the IPM, and a control signal is output by the IPM to cut off a drive power supply for the motor to protect the motor.

The exhaust overpressure protection signal output from the compressor exhaust pressure detection protection unit is input to an input terminal of the voltage comparator IC4A via a resistor R7 to generate a virtual high voltage which is higher than the reference voltage Vref3 at 0.5V of the voltage comparator IC4A, the voltage comparator IC4A outputs a high level signal to trigger the time delay circuit TD of the safety locking unit, a low level signal is output from the time delay circuit TD to lock the AND gates IC2A, IC2B, IC2C, IC3A, IC3B and IC3C and thereby cut off a three-phase signal for driving the IPM output from the central processing unit along six paths.

The exhaust overpressure protection signal output from the compressor exhaust pressure detection protection unit is input to an input terminal P1.1 of the central processing unit via a resistor R5 and a clamping diode D1, the central processing unit performs a calculation internally based on the exhaust overpressure protection signal output from the compressor exhaust pressure detection protection unit, and outputs a control signal to cut off the compressor current.

Still referring to FIG. 5, in the case that the exhaust pressure of the air conditioner compressor is too high, the compressor exhaust temperature is high, a resistance of the thermistor sensor ODT with the negative temperature coefficient of the compressor exhaust temperature detection protection unit is small, such that a voltage of a node A at one terminal of the ODT temperature sensor increases and exceeds a threshold Vref2 of the voltage comparator IC1A, an open circuit occurs, loops of light emitting diodes of two isolation optical couplers OP3 and OP4 series-connected to the voltage comparator IC1A are power off, another terminal of the optical coupler is also cut off, i.e., in an open circuit, and an output terminal node C of the optical coupler OP4 is on a high level, that is, an exhaust over-temperature protection signal is output from the compressor exhaust temperature detection protection unit. In the embodiment of the disclosure as shown in FIG. 5, output terminals of the optical couplers OP3 and OP4 of the compressor exhaust temperature detection protection unit are connected to output terminals of the optical couplers OP1 and OP2 of the compressor exhaust temperature detection protection unit in series. In the case that the OP3 or OP4 opens, the output terminal of the OP1 is on the high level, the exhaust over-temperature protection signal output from the compressor exhaust temperature detection protection unit is input to an input terminal Cin of the IPM via the optical couplers OP1 and OP2 of the compressor exhaust pressure detection protection unit and a resistor R6, a virtual high voltage received by the input terminal Cin of the IPM exceeds an over-current reference voltage of the over-current voltage comparator of the IPM, a control signal is output from the IPM to cut off a drive power supply for the motor to protect the motor.

The exhaust over-temperature protection signal output from the compressor exhaust temperature detection protection unit is input to an input terminal of the voltage comparator IC4A via output terminals of the optical couplers OP1 and OP2 of the compressor exhaust pressure detection protection unit and a resistor R7, and a reference voltage Vref3 at 0.5V is input to another terminal of the voltage comparator IC4A. The exhaust over-temperature protection signal output from the compressor exhaust temperature detection protection unit is compared with the reference voltage Vref3 within the voltage comparator IC4A. In the case that the exhaust over-temperature signal output from the compressor exhaust temperature detection protection unit is higher than the reference voltage Vref3, the voltage comparator IC4A outputs a virtual high voltage to trigger the time delay circuit TD of the safety locking unit, and a low level signal is output from the time delay circuit TD to lock the AND gates IC2A, IC2B, IC2C, IC3A, IC3B and IC3C and cut off a three-phase signal for driving the IPM output from the central processing unit along six paths. Alternatively, the exhaust over-temperature protection signal output from the compressor exhaust temperature detection protection unit may be input to the voltage comparator IC4A directly, without passing through the OP1 of the compressor exhaust pressure detection protection unit.

In the embodiment of the disclosure, output terminals of the optical couplers OP3 and OP4 of the compressor exhaust temperature detection protection unit are connected to output terminals of the optical couplers OP1 and OP2 of the compressor exhaust pressure detection protection unit in series. In this way, any action from the compressor exhaust temperature detection protection unit or the compressor exhaust pressure detection protection unit may input a protection signal to the input terminal Cin of the IPM for safety. Practically, in other embodiments, output terminals of the optical couplers OP3 and OP4 of the compressor exhaust temperature detection protection unit may be connected to the input terminal Cin of the IPM directly.

The exhaust over-temperature protection signal output from the compressor exhaust temperature detection protection unit is input to the input terminal P1.2 of the central processing unit via a resistor R8 and a clamping diode D2. The central processing unit performs a calculation upon the reception of the exhaust over-temperature protection signal output from the compressor exhaust temperature detection protection unit, and then outputs a control signal to cut off the compressor current.

In the specific embodiment as shown in FIG. 5, the compressor exhaust pressure detection protection unit and the compressor exhaust temperature detection protection unit isolate a signal collected by the sensor (for example the HPS and the ODT temperature sensor) from the central processing unit by the optical couplers, such that the central processing unit is protected, and the temperature sensor and the high pressure protection switch are ensured to operate with an isolation power source safely. In addition, two or more series-connected optical couplers are adopted in each isolation circuit, by which the output terminal of one optical coupler is breakdown or shot circuited can be tolerated; and once one optical coupler is short circuited, another optical coupler can still transmit the alarm signal.

Figure 6:
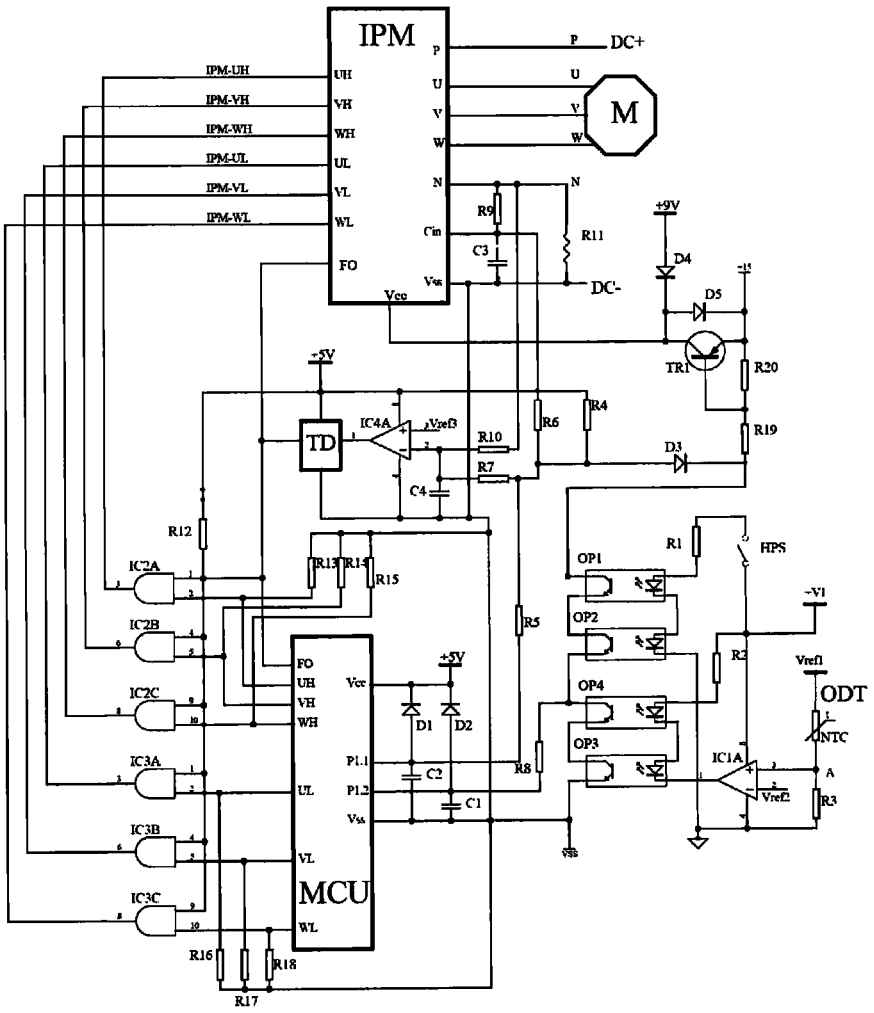
FIG. 6 is a schematic circuit diagram of an air conditioner controller according to a third embodiment of the disclosure.

Reference is made to FIG. 6, which is a schematic circuit diagram of an air conditioner controller according to a third embodiment of the disclosure. In the embodiment, the air conditioner is a variable frequency air conditioner, and the drive unit is an intelligent power module (IPM) including an intelligent control (IC) circuit and a three-phase inverter bridge including a switching transistor. The IPM includes a voltage comparator and a locking circuit.

In the third embodiment of the air conditioner controller as shown in FIG. 6, the protection detection unit also includes the over-current detection unit, the compressor exhaust pressure detection protection unit and the compressor exhaust temperature detection protection unit; the safety locking unit also the time delay circuit TD, and the same parts between the third embodiment and the second embodiment of the air conditioner controller are not described here. The third embodiment differs from the second embodiment in that: in the third embodiment as shown in FIG. 6, besides connecting to an over-current protection input terminal Cin of the IPM, the optical coupler OP1 of the compressor exhaust pressure detection protection unit controls a power supply input terminal Vcc of the IPM via a switching transistor TR1.

An under-voltage comparator and a locking circuit are provided within the IPM, and an under-voltage protection reference voltage of the under-voltage comparator is generally 11V. In the case that a voltage of an under-voltage protection input terminal of the IPM is lower than the under-voltage protection reference voltage of the under-voltage comparator, i.e., 11V, a control signal is output from the locking circuit of the IPM to turn off the switching transistor of the three-phase inverter bridge of the IPM and thereby stop providing power for the motor, and an FO alarm signal is output to notify the MCU to cut off the control drive signal for the motor. In the case that the voltage of the under-voltage protection input terminal of the IPM is higher than the under-voltage protection reference voltage of the under-voltage comparator, i.e., 11V, the IPM operates normally. Since the operation of elements in the IPM needs power supply, a voltage of the power supply input terminal Vcc of the IPM should not be too low, for example, the voltage should be higher than 0. The structure of the IPM needs not to be described hereinafter.

As shown in FIG. 6, the output terminal of the optical coupler OP1 of the compressor exhaust pressure detection protection unit is connected to a control terminal of the switching transistor TR1 via a resistor R19; a first terminal of the switching transistor TR1 is connected to a 9V power supply via a diode D4, and a second terminal of the switching transistor TR1 is connected to a 15V power supply; and the first terminal of the switching transistor TR1 is connected to an power supply Vcc of the IPM. In the case of a normal compressor exhaust pressure, the optical coupler of the compressor exhaust pressure detection protection unit is turned on, a voltage of the output terminal of the optical coupler OP1 of the compressor exhaust pressure detection protection unit is a low voltage close to Vss, hence the control terminal of the switching transistor TR1 is on the low level and the switching transistor TR1 is turned on. In this case, a first voltage of 15V is input to the Vcc of the IPM, and the first voltage is higher than the under-voltage protection voltage 11V, hence the IPM operates normally. In the case that the compressor exhaust pressure is too high, the optical coupler OP1 of the compressor exhaust pressure detection protection unit is in an open circuit, a voltage of the control terminal of the switching transistor TR1 is on the high level, a base electrode of the TR1 is in an open circuit and the switching transistor TR1 is turned off. In this case, the diode D4 series-connected to the 9V power supply is turned on, a voltage input to the Vcc of the IPM is 9V lower than the under-voltage protection voltage 11V of the IPM, a control signal is output from the IPM to turn off the switching transistor of the three-phase inverter bridge of the IPM and thereby stop providing power for the motor; in addition, an FO signal is output to the MCU to cut off the drive signals from six paths.

In the embodiments mentioned above, the voltage of the power supply connected to the first terminal of the switching transistor TR1 is 15V, and the voltage of the power supply connected to the second terminal of the switching transistor TR1 is 9V; alternatively, in other embodiments, the voltage of the power supply connected to the second terminal of the switching transistor TR1 may range from 4V to 10V, i.e., less than the under-voltage reference voltage of the IPM; and the voltage of the power supply connected to the first terminal of the switching transistor may be higher than 11V, i.e., higher than the under-voltage reference voltage of the IPM.

The above content only describes several specific embodiments for driving the air conditioner motor in the disclosure, in other embodiments, the air conditioner controller of the disclosure may also be used to control other elements of the air conditioner, accordingly the drive unit for driving the air conditioner motor is replaced with drive units for driving other elements of the air conditioner, which is not described by an example.

The above embodiments each describe the air conditioner controller. It should be understood that the embodiments of the disclosure may also describe an air conditioner control circuit. The air conditioner control circuit provided by the embodiments of the disclosure may include the central processing unit, the protection detection unit, the drive unit and the safety locking unit described above, the specific features and operation ways may be referred to the circuit and its control mode described above. In addition, the embodiments of the disclosure may also describe the air conditioner controller including the air conditioner control circuit.

Corresponding to the air conditioner control circuit and the air conditioner controller described in the above embodiments, an air conditioner control method is further provided according to the disclosure. The air conditioner applying the method may include an air conditioner motor and an air conditioner controller for controlling an operation of the air conditioner motor; the air conditioner controller includes an air conditioner control circuit, and the air conditioner control circuit includes a central processing unit, an air conditioner motor drive unit, a protection detection unit and a safety locking unit. According to an embodiment, the method includes:

outputting, by the central processing unit, an air conditioner control signal; and detecting, by the protection detection unit, an operation condition of the air conditioner and outputting a detection protection signal based on the detected operation condition;

receiving, by the safety locking unit, the air conditioner control signal and the detection protection signal, outputting a drive control signal to the air conditioner motor drive unit, and controlling the air conditioner control signal output from the central processing unit to the air conditioner motor drive unit to be transmitted or cut off based on the detection protection signal output from the protection detection unit; and receiving, by the air conditioner motor drive unit, the drive control signal and the detection protection signal, and outputting a drive signal to control an operation of the air conditioner motor, where the drive signal is output by the air conditioner motor drive unit based on the drive control signal and the detection protection signal.

According to another embodiment, the method may further include:

receiving, by the central processing unit, the detection protection signal; and determining whether to output the air conditioner control signal based on the detection protection signal.

In yet another embodiment, the detection protection signal includes at least one of an exhaust pressure protection signal, an exhaust temperature protection signal and an over-current protection signal; and the detecting an operation condition of the air conditioner and outputting a detection protection signal based on the detected operation condition using the protection detection unit includes at least one of the following sub-steps:

detecting, by the protection detection unit, an exhaust pressure of a compressor of the air conditioner, and outputting the exhaust pressure protection signal in the case that the detected exhaust pressure reaches a predetermined air pressure threshold;

detecting, by the protection detection unit, an exhaust temperature of the compressor of the air conditioner, and outputting the exhaust temperature protection signal in the case that the detected exhaust temperature reaches a predetermined temperature threshold; and controlling a current of the compressor of the air conditioner to pass through a current sampling resistor, detecting, by the protection detection unit, a voltage across the current sampling resistor, and outputting the over-current protection signal in the case that the detected voltage across the current sampling resistor reaches a predetermined voltage threshold.

In still another embodiment, the method may further include:

controlling the central processing unit to stop outputting the air conditioner control signal, in the case that at least one of the exhaust pressure protection signal, the exhaust temperature protection signal and the over-current protection signal is received by the central processing unit; controlling the air conditioner motor drive unit to stop driving the air conditioner motor, in the case that at least one of the exhaust pressure protection signal, the exhaust temperature protection signal and the over-current protection signal is received by the air conditioner motor drive unit; and cutting off, by the safety locking unit, the air conditioner control signal transmitted from the central processing unit, in the case that at least one of the exhaust pressure protection signal, the exhaust temperature protection signal and the overcurrent protection signal is received by the safety locking unit.

In another embodiment, the protection detection unit further includes an isolation circuit, and the isolation circuit includes two or more series-connected optical couplers; and the method further includes:

isolating, by the isolation circuit, the exhaust pressure protection signal and/or the exhaust temperature protection signal from the central processing unit.

In the air conditioner control circuit, the air conditioner controller and the air conditioner control method according to the disclosure, the protection signal is transmitted on three paths. On the first path, the protection signal output from the protection detection unit is input directly to the drive unit of the air conditioner motor, and the drive unit stops driving the air conditioner motor; on the second path, the protection signal is transmitted to the safety locking unit to cut off the drive control signal transmitted from the central processing unit to the drive unit; on the third path, the protection signal is output to the central processing unit along to control the central processing unit to stop sending the drive signal. In this way, the central processing unit, the safety locking unit and the drive unit of the air conditioner controller each may control an operation of the air conditioner motor based on the detection signal from the protection detection unit. A hardware protection circuit is adopted in each of the drive unit and the safety locking unit, once one path does not operate normally due to the breakdown of an element, the protection signal still can be transmitted on other two paths, thereby triple safety protection is provided. In addition, the signal output from the protection detection unit is isolated from the central processing unit, the safety locking unit and the drive unit by two series-connected optical couplers, thereby avoiding the damage to each processing unit caused by the detection signal directly input to the processing unit, and ensuring that the protection detection unit operates safely with an isolation power supply. Two series-connected optical couplers are adopted in the protection detection unit, by which the case that the output terminal of one optical coupler is breakdown or shot circuited can be tolerated; once a failure occurs in one optical coupler, the other optical coupler can still transmit the protection signal, thereby providing multiple types of safety protection for the air conditioner. In the above embodiments, the protection signal from the protection detection unit is input to the central processing unit, the safety locking unit and the drive unit;

alternatively, in other embodiments, the protection signal from the protection detection unit may be not input to the central processing unit, and only the safety locking unit and the drive unit provide protection for the air conditioner.

It should be noted that, the above embodiments are only used to describe the disclosure but not to limit the technical solutions described in the disclosure. Although the disclosure has been described in detail referring to the above embodiments in the specification, those skilled in the art should understand that changes or equivalent substitutions may be made to the disclosure, and any technical solutions and improvements thereof without departing from the spirit and range of the disclosure should fall within the scope of protection of claims of the disclosure.

The invention claimed is:

1. An air conditioner control circuit, comprising:

a central processing unit, an air conditioner motor drive unit, a protection detection unit and a safety locking unit, wherein the protection detection unit detects an operation condition of an air conditioner and outputs a detection protection signal;

the central processing unit outputs an air conditioner control signal;

the air conditioner motor drive unit receives a drive control signal output from the safety locking unit and the detection protection signal output from the protection detection unit, and outputs a drive signal to control an operation of an air conditioner motor, wherein the drive signal is capable of being output by the air conditioner motor drive unit based on the drive control signal and the detection protection signal; and the safety locking unit receives the detection protection signal output from the protection detection unit and the air conditioner control signal output from the central processing unit, outputs the drive control signal, and controls the air conditioner control signal output from the central processing unit to the air conditioner motor drive unit to be transmitted or cut off based on the detection protection signal output from the protection detection unit.

2. The air conditioner control circuit according to claim 1, wherein an output terminal of the protection detection unit is connected to an input terminal of the central processing unit, the central processing unit receives the detection protection signal output from the protection detection unit and outputs the air conditioner control signal, wherein the detection protection signal is an input source of the air conditioner control signal output from the central processing unit, and the central processing unit is a microprocessor or a device for sending a switch on/off instruction.

3. The air conditioner control circuit according to claim 1, wherein an output terminal of the protection detection unit is connected to an input terminal of the safety locking unit and an input terminal of the air conditioner motor drive unit, an output terminal of the central processing unit is connected to another input terminal of the safety locking unit, an output terminal of the safety locking unit is connected to another input terminal of the air conditioner motor drive unit, and a drive signal is output from an output terminal of the air conditioner motor drive unit to control an operation of the air conditioner motor.

4. The air conditioner control circuit according to claim 3, wherein the protection detection unit comprises at least one of an over-current detection protection unit, a compressor exhaust pressure detection protection unit, and a compressor exhaust temperature detection protection unit; at least one of the compressor exhaust pressure detection protection unit and the compressor exhaust temperature detection protection unit comprises at least two optical couplers, and at least one of a detection protection signal output from the compressor exhaust pressure detection protection unit and a detection protection signal output from the compressor exhaust temperature detection protection unit is isolated by at least two series-connected optical couplers and then is output.

5. The air conditioner control circuit according to claim 4, wherein each of the compressor exhaust pressure detection protection unit and the compressor exhaust temperature detection protection unit comprises the optical coupler, and an output terminal of the optical coupler of the compressor exhaust pressure detection protection unit is connected to an output terminal of the optical coupler of the compressor exhaust temperature detection protection unit in series.

6. The air conditioner control circuit according to claim 4, wherein the compressor exhaust pressure detection protection unit comprises a high pressure detection protection switch; in the case that an exhaust pressure of the air conditioner compressor is a normal air pressure, the high pressure detection protection switch is in an on-state; in the case that the exhaust pressure of the air conditioner compressor is greater than or equal to a predetermined threshold, the high pressure detection protection switch is turned off to cut off a loop of a light emitting diode of the optical coupler, to make the optical coupler is power off and turned off, and an exhaust pressure protection signal is output.

7. The air conditioner control circuit according to claim 4, wherein the compressor exhaust temperature detection protection unit comprises a thermistor sensor with a negative temperature coefficient; the thermistor sensor with the negative temperature coefficient is connected to one input terminal of a voltage comparator, and a reference voltage is input to another input terminal of the voltage comparator; in the case that an exhaust temperature of the air conditioner compressor exceeds a predetermined value, a resistance of the thermistor sensor with the negative temperature coefficient reduces, a voltage of the input terminal of the connected voltage comparator is higher than the reference voltage, and an output terminal of the voltage comparator cuts off a loop of a light emitting diode of the optical coupler, to make the optical coupler is power off and turned off, and an exhaust temperature protection signal is output.

8. The air conditioner control circuit according to claim 4, wherein the overcurrent detection protection unit comprises a current sampling resistor and a voltage comparator, a current sampling signal obtained from the current sampling resistor is transmitted to one input terminal of the voltage comparator; and an overcurrent detection protection signal is output from the voltage comparator to the safety locking unit and the safety locking unit cuts off the control signal output from the central processing unit to the air conditioner motor drive unit, in the case that a voltage received by the input terminal of the voltage comparator for receiving the current sampling signal exceeds a reference voltage input to another input terminal of the voltage comparator.

9. The air conditioner control circuit according to claim 1, wherein the protection detection unit comprises at least one of an over-current detection protection unit, a compressor exhaust pressure detection protection unit and a compressor exhaust temperature detection protection unit; at least one of the compressor exhaust pressure detection protection unit and the compressor exhaust temperature detection protection unit comprises at least two optical couplers, and at least one of a detection protection signal output from the compressor exhaust pressure detection protection unit and a detection protection signal output from the compressor exhaust temperature detection protection unit is isolated by at least two series-connected optical couplers.

10. The air conditioner control circuit according to claim 1, wherein the safety locking unit comprises an AND gate, the detection protection signal output from the protection detection unit is input to one input terminal of the AND gate, the air conditioner control signal output from the central processing unit is input to another input terminal of the AND gate, and the drive control signal for controlling the drive unit is output from an output terminal of the AND gate.

11. The air conditioner control circuit according to claim 10, wherein the safety locking unit further comprises a time delay circuit, the detection protection signal output from the protection detection unit is delayed by the time delay circuit and is input to one input terminal of the AND gate, the signal output from the central processing unit is input to the other input terminal of the AND gate, and the drive control signal for controlling the drive unit is output from the output terminal of the AND gate.

12. The air conditioner control circuit according to claim 10, wherein the drive unit is an intelligent power module IPM comprising an intelligent control circuit and a three-phase inverter bridge, the over-current detection signal is transmitted to an over-current signal input terminal of the IPM, the IPM comprises a voltage comparator and a locking circuit, and the locking circuit determines whether to lock the output of the drive signal for driving the motor based on a comparison between a current signal input to the over-current signal input terminal and a protection reference voltage of the voltage comparator.

13. The air conditioner control circuit according to claim 10, wherein the drive unit is an intelligent power module IPM comprising an intelligent control circuit and a three-phase inverter bridge; the detection protection signal is input to a power supply input terminal of the IPM via a switching transistor, and the IPM comprises an under-voltage protection comparator and a locking circuit for locking the output of the drive signal for driving the motor; an output terminal of the protection detection unit is connected to a control terminal of the switching transistor, a first voltage is applied to a first terminal of the switching transistor, and a second voltage is applied to a second terminal of the switching transistor; the detection protection signal controls whether the switching transistor is turned on, the second voltage is input to a voltage input terminal of the IPM in the case that the switching transistor is turned on, or the first voltage is input to the voltage input terminal of the IPM in the case that the switching transistor is turned off, wherein the first voltage is lower than the under-voltage protection reference voltage and the second voltage is higher than the under-voltage protection reference voltage.

14. The air conditioner control circuit according to claim 10, wherein the drive unit is a relay switch; the relay switch is turned on and outputs a drive signal in the case that a relay coil of the relay switch is power on, the switch relay is turned off and does not output a drive signal in the case that the relay coil of the relay switch is power off.

15. The air conditioner control circuit according to claim 14, wherein the relay coil is connected to a diode in parallel, the output terminal of the protection detection unit is connected to a negative electrode of the diode via a switching transistor, the output terminal of the protection detection unit is connected to a control terminal of the switching transistor, a first terminal of the switching transistor is connected to the negative electrode of the diode, a second terminal of the switching transistor is connected to a power supply, wherein the detection protection signal controls whether the switching transistor is turned on, and the relay coil is power on in the case that the switching transistor is turned on.

16. An air conditioner controller, comprising an input terminal and an output terminal, wherein the input terminal receives a signal from a sensor and an air conditioner control instruction signal, and the output terminal outputs an air conditioner element control signal;

and the air conditioner controller further comprises an air conditioner control circuit; wherein the air conditioner control circuit comprises:

a central processing unit, an air conditioner motor drive unit, a protection detection unit and a safety locking unit; wherein the protection detection unit detects an operation condition of an air conditioner and outputs a detection protection signal;

the central processing unit outputs an air conditioner control signal;

the air conditioner motor drive unit receives a drive control signal output from the safety locking unit and the detection protection signal output from the protection detection unit, and outputs a drive signal to control an operation of an air conditioner motor, wherein the drive signal is capable of being output by the air conditioner motor drive unit based on the drive control signal and the detection protection signal; and the safety locking unit receives the detection protection signal output from the protection detection unit and the air conditioner control signal output from the central processing unit, outputs the drive control signal, and controls the air conditioner control signal output from the central processing unit to the air conditioner motor drive unit to be transmitted or cut off based on the detection protection signal output from the protection detection unit.

17. The air conditioner controller according to claim 16, wherein an output terminal of the protection detection unit is connected to an input terminal of the central processing unit; the central processing unit receives a detection protection signal output from the protection detection unit and outputs an air conditioner control signal, wherein the detection protection signal is one input source of the air conditioner control signal output from the central processing unit, and the central processing unit is a microprocessor or a device for sending a switch on/off instruction.

18. The air conditioner controller according to claim 16, wherein the protection detection unit comprises at least one of an over-current detection protection unit, a compressor exhaust pressure detection protection unit and a compressor exhaust temperature detection protection unit; at least one of the compressor exhaust pressure detection protection unit and the compressor exhaust temperature detection protection unit comprises at least two optical couplers, and at least one of a detection protection signal output from the compressor exhaust pressure detection protection unit and a detection protection signal output from the compressor exhaust temperature detection protection unit is isolated by at least two series-connected optical couplers and then is output.

19. An air conditioner controller method, wherein the air conditioner comprises an air conditioner motor and an air conditioner controller for controlling an operation of the air conditioner motor, the air conditioner controller comprises an air conditioner control circuit, the air conditioner control circuit comprises a central processing unit, an air conditioner motor drive unit, a protection detection unit and a safety locking unit; and the method comprises:

outputting, by the central processing unit, an air conditioner control signal;

detecting, by the protection detection unit, an operation condition of the air conditioner and outputting a detection protection signal based on the detected operation condition;

receiving, by the safety locking unit, the air conditioner control signal and the detection protection signal, outputting a drive control signal to the air conditioner motor drive unit, and controlling the air conditioner control signal output from the central processing unit to the air conditioner motor drive unit to be transmitted or cut off based on the detection protection signal output from the protection detection unit; and receiving, by the air conditioner motor drive unit, the drive control signal and the detection protection signal, and outputting a drive signal to control an operation of the air conditioner motor, wherein the drive signal is capable of being output by the air conditioner motor drive unit based on the drive control signal and the detection protection signal.

20. The method according to claim 19, further comprising:

receiving, by the central processing unit, the detection protection signal, and determining whether to output the air conditioner control signal based on the detection protection signal.

21. The method according to claim 19, wherein the detection protection signal comprises at least one of an exhaust pressure protection signal, an exhaust temperature protection signal and an overcurrent protection signal; and the step of detecting an operation condition of the air conditioner and outputting a detection protection signal based on the detected operation condition using the protection detection unit comprises at least one of the following sub-steps:

detecting, by the protection diction unit, an exhaust pressure of a compressor of the air conditioner, and outputting the exhaust pressure protection signal in the case that the detected exhaust pressure reaches a predetermined air pressure threshold;

detecting, by the protection detection unit, an exhaust temperature of the compressor of the air conditioner, and outputting the exhaust temperature protection signal in the case that the detected exhaust temperature reaches a predetermined temperature threshold; and controlling a current of the compressor of the air conditioner to pass through a current sampling resistor, detecting, by the protection detection unit, a voltage across the current sampling resistor, and outputting the overcurrent protection signal in the case that the detected voltage across the current sampling resistor reaches a predetermined voltage threshold.

22. The method according to claim 21, further comprising:

controlling the central processing unit to stop outputting the air conditioner control signal, in the case that at least one of the exhaust pressure protection signal, the exhaust temperature protection signal and the overcurrent protection signal is received by the central processing unit; controlling the air conditioner motor drive unit to stop driving the air conditioner motor, in the case that at least one of the exhaust pressure protection signal, the exhaust temperature protection signal and the overcurrent protection signal is received by the air conditioner motor drive unit; and cutting off, by the safety locking unit, the air conditioner control signal transmitted from the central processing unit, in the case that at least one of the exhaust pressure protection signal, the exhaust temperature protection signal and the overcurrent protection signal is received by the safety locking unit.

23. The method according to claim 22, wherein the protection detection unit further comprises an isolation circuit, and the isolation circuit comprises two or more series-connected optical couplers; and the method further comprises:

isolating, by the isolation circuit, the exhaust pressure protection signal and/or the exhaust temperature protection signal from the central processing unit.

* * * * *